US007661970B2

(12) United States Patent
Fukamachi

(10) Patent No.: US 7,661,970 B2
(45) Date of Patent: Feb. 16, 2010

(54) CONNECTOR

(75) Inventor: Makoto Fukamachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/266,665

(22) Filed: Nov. 7, 2008

(65) Prior Publication Data

US 2009/0130877 A1 May 21, 2009

(30) Foreign Application Priority Data

Nov. 15, 2007 (JP) ..... 2007-296432

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 5,709,560 A 1/1998 Hio
5,810,612 A * 9/1998 Flask et al. ..... 439/157
6,203,340 B1 * 3/2001 Yamashita et al. ..... 439/157
6,213,795 B1 * 4/2001 Drescher et al. ..... 439/157
6,471,527 B2 * 10/2002 Fukamachi et al. ..... 439/157
6,764,324 B2 * 7/2004 Shinozaki et al. ..... 439/157
7,559,779 B1 * 7/2009 Caines et al. ..... 439/157

* cited by examiner

*Primary Examiner*—Truc T Nguyen
(74) *Attorney, Agent, or Firm*—Gerald E. Hespos; Anthony J. Casella

(57) ABSTRACT

Supporting shafts (18) are provided on a cover (12) of a housing (10), and bearings (70) are provided in a lever (60). Each supporting shaft (18) includes retaining pieces (21) around a recess (20) at an inner side, and the retaining pieces (21) are inserted into the bearings (70) and leading-end flanges (23) thereof are resiliently engageable with opening edges of the bearings (70). Each bearing (70) includes a restriction (72) insertable into the recess (20) from a leading end of the supporting shaft (18). The restrictions (72) are displaceable to deformation permitting areas where resilient deformations of the retaining pieces toward the recesses (20) are permitted when the lever (60) is assembled and to deformation preventing areas where the resilient deformations of the retaining pieces (21) toward the recesses (20) are prevented by interference of the restricts (72) with the retaining pieces (21) as the lever (60) is rotated.

11 Claims, 13 Drawing Sheets

CONNECTOR

BACKGROUND OF THE INVENTION

1. Field of the Invention

The invention relates to a connector.

2. Description of the Related Art

U.S. Pat. No. 5,709,560 discloses a connector with a housing and supporting shafts on the housing. The connector also has a lever that is mounted rotatably on the shafts. The lever engages a mating connector and functions as a force multiplying mechanism as the lever is rotated for moving the connector and the mating connector to a properly connected state with a low operation force. The lever has bearings and each supporting shaft has two retaining pieces that face each other with a linear slit therebetween. The retaining pieces deform resiliently towards the slits as the shafts are inserted into the bearings while assembling the lever. Leading ends of the retaining pieces resiliently engage the opening edges of the bearings to prevent detachment of the lever from the housing when the lever is assembled properly.

An operation force associated with the connection of the housing and the mating connector increases in the process of rotating the lever and deforms the retaining pieces towards the slits. As a result, there has been a likelihood that the lever will widened and inadvertently detach from the housing.

The invention was developed in view of the above situation and an object thereof is to prevent a lever from being detached from a housing.

SUMMARY OF THE INVENTION

The invention relates to a connector comprising a housing that is connectable with a mating connector. A lever is supported displaceably on the housing and is engageable with the mating connector. The lever functions as a force multiplying mechanism for properly connecting the housing and the mating connector by displacing the lever while the lever is engaged with the mating connector. One of the lever and the housing includes a supporting shaft and the other thereof includes a bearing. The supporting shaft includes one or more retaining pieces around or adjacent to a recess located at an inner side. The retaining pieces are inserted into the bearing and have one or more leading-end flanges resiliently engageable with an opening edge of the bearing. The bearing includes at least one restriction that is insertable into the recess from a leading end of the supporting shaft. The restriction is displaceable to a deformation permitting area where resilient deformations of the retaining pieces towards the recess are permitted when the lever is assembled and to a deformation preventing area where resilient deformations of the retaining pieces towards the recess are prevented as the lever is operated.

The restriction is in the deformation permitting area when the lever is assembled. Thus, the retaining pieces are deformed resiliently towards the recess and are inserted into the bearing with leading-end flanges thereof engaged resiliently with the opening edge of the bearing. As a result, the lever can be mounted smoothly on the housing so as not to come off. On the other hand, the restriction is in the deformation preventing area in the process of rotating the lever. Thus, the retaining pieces will not deform towards the recess and the retaining pieces are kept retained in the bearing. As a result, the lever will not detach from the housing.

The lever preferably is displaceable to an assembled position corresponding to the deformation permitting area, a standby position where the engagement with the mating connector can be started and a proper connection position where the housing is connected properly.

The assembled position preferably is not located between the standby position and the proper connection position corresponding to the deformation preventing area. Thus, there is no likelihood that the retaining pieces will deform resiliently towards the recess and into a position where the lever is detached accidentally in the process of connecting the housing and the mating connector. Thus, connection stability is good.

The restriction preferably has a substantially bar shape extending along a radial direction of the recess and is arranged in a tense state between two retaining pieces substantially facing each other with the recess therebetween in the resilient deformation area. As a result, resilient deformation of both retaining pieces is prevented with high rigidity and detachment of the lever is hindered more reliably.

The restrictions preferably are located at least partly in the deformation permitting areas when the lever is at the assembled position. Thus, resilient deformation of the retaining pieces towards the recesses is permitted, thereby ensuring a smooth assembly of the lever.

A lever partial locking portion preferably is provided and engages an interlocking portion to hold the lever at the assembled position.

The retaining piece preferably have leading-end flanges with projecting ends that are held substantially in sliding contact with the inner circumferential surfaces of the bearing in the assembling process of the lever. At least one restriction is connected integrally or unitarily with the lever and is located at least partly in the deformation permitting areas so that the retaining pieces are deformed resiliently towards the recesses. As a result, the supporting shaft can be inserted into the bearing.

The resiliently deformed retaining pieces preferably contact with one or more projections of the restrictions to prevent excessive deformations of the retaining pieces.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
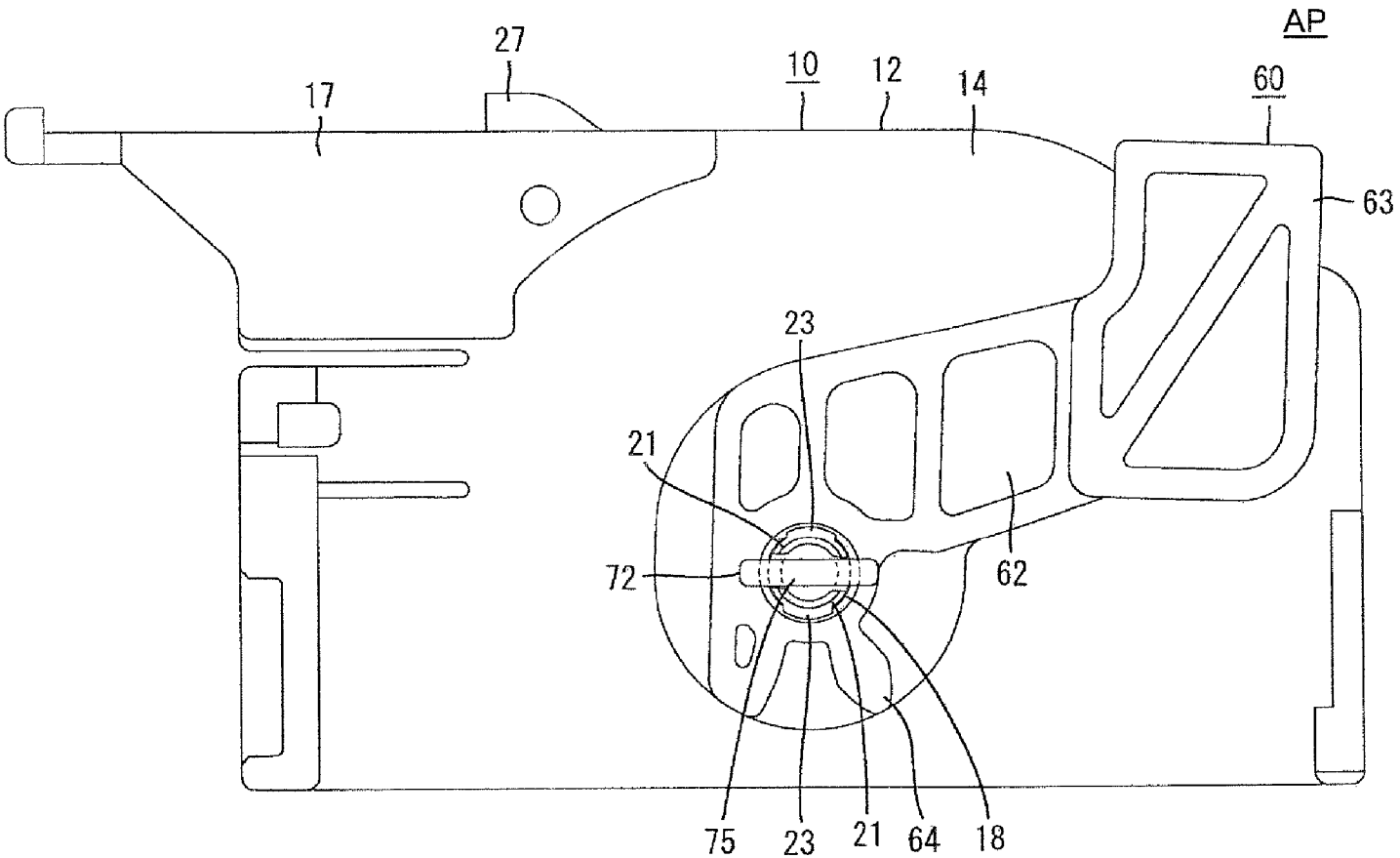
FIG. 1 is a side view of a connector with a lever left at an assembled position in one embodiment of the invention.

A connector in accordance with the invention is illustrated in FIGS. 1 to 14. The connector has a housing 10 and a lever 60. The housing 10 is connectable with a mating connector (not shown) with a low operation force by the action of a force multiplying mechanism as the lever 60 is pivoted. In the following description, an end to be connected with the mating connector is referred to as the front concerning forward and backward directions and a right side in FIG. 1 is referred to as an upper side concerning a vertical direction.

Figure 14:
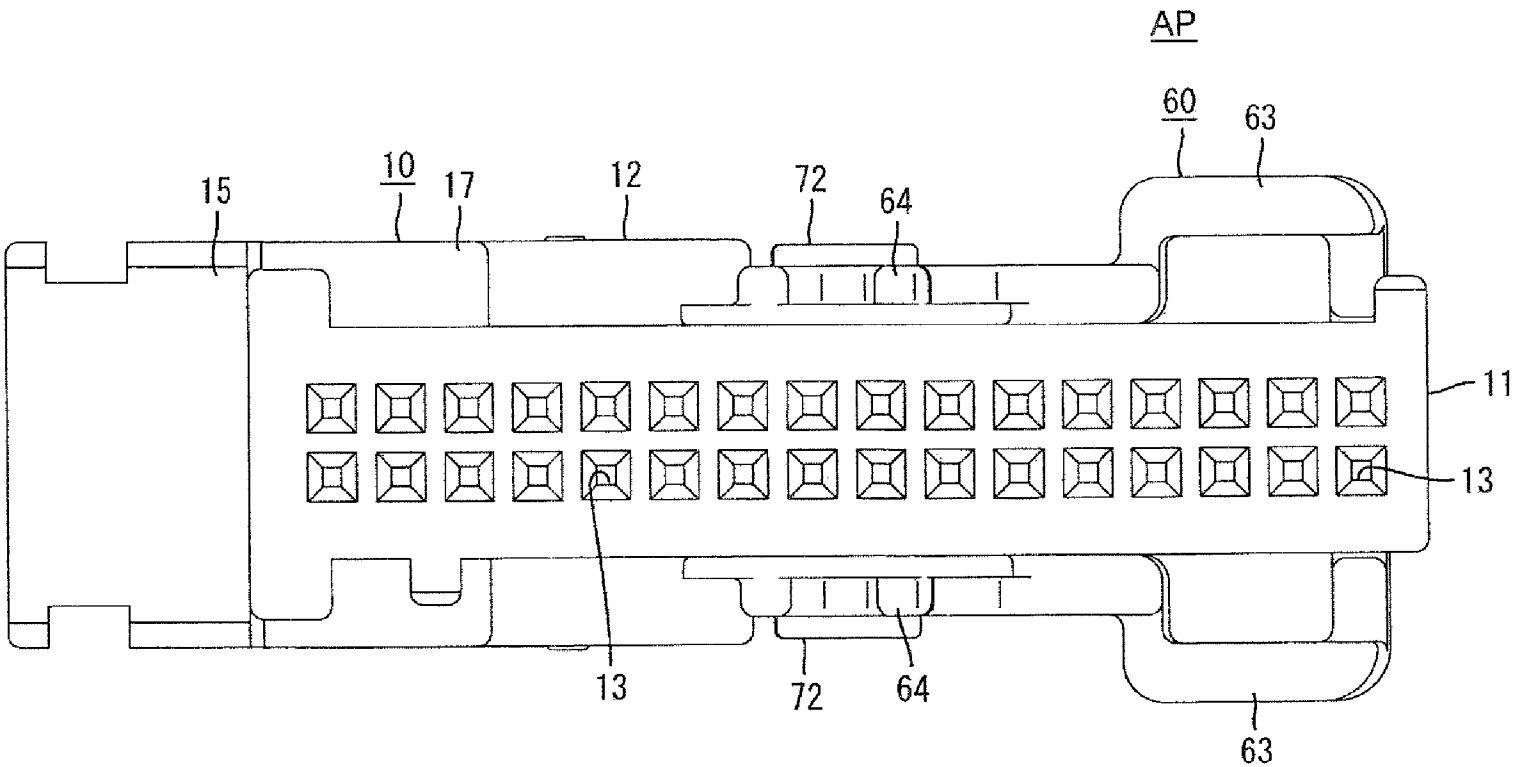
FIG. 14 is a front view of the connector with the lever left at the assembled position.

The housing 10 is made e.g. of synthetic resin and includes a housing main body 11. A cover 12 is mounted on the housing main body 11 to at least partly cover the rear of the housing main body 11, as shown in FIG. 14. Cavities 13 are arranged in the housing main body 11 for receiving the terminal fittings connected with ends of wires.

Figure 9:
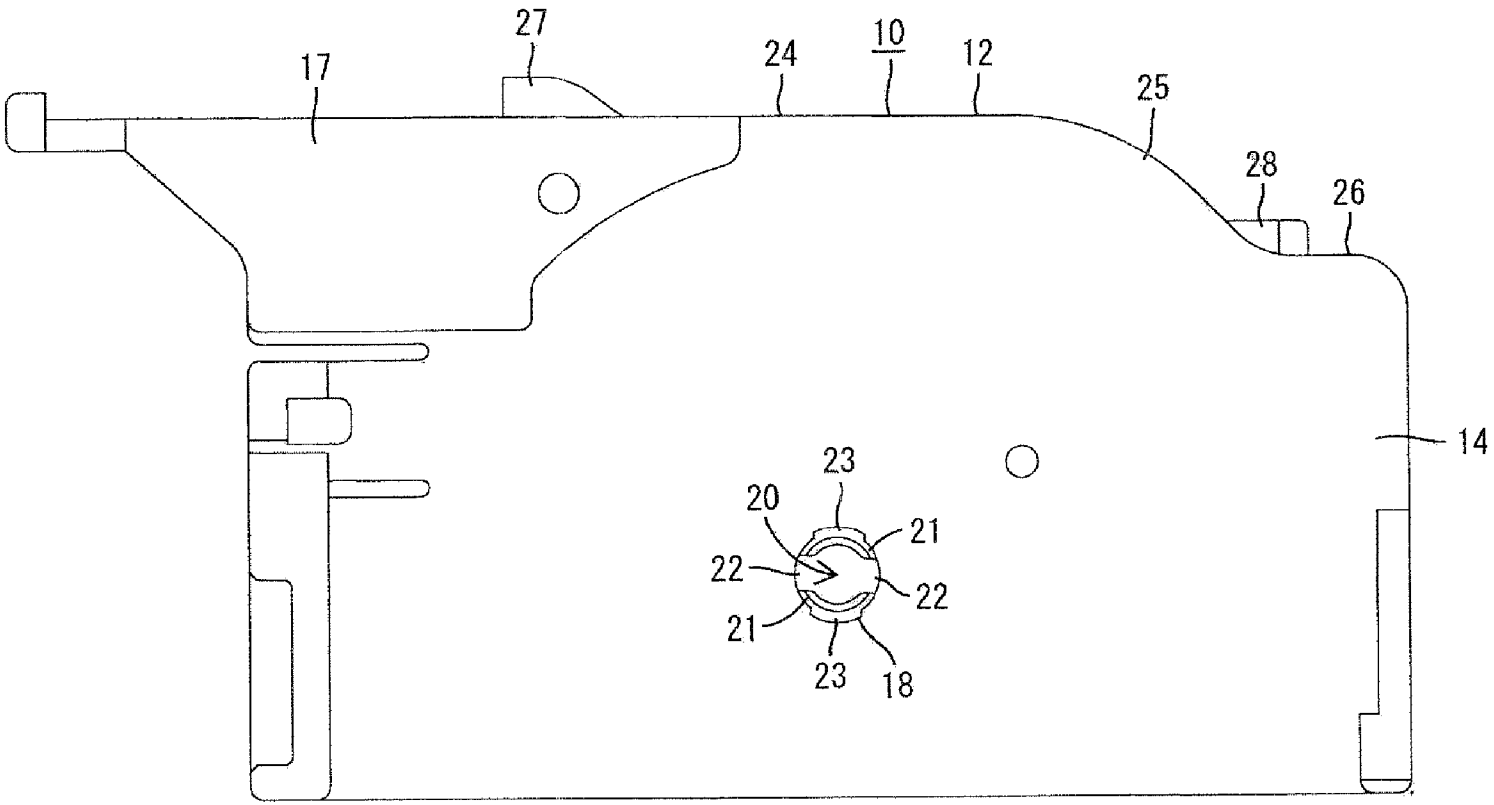
FIG. 9 is a side view of a cover.
Figure 10:
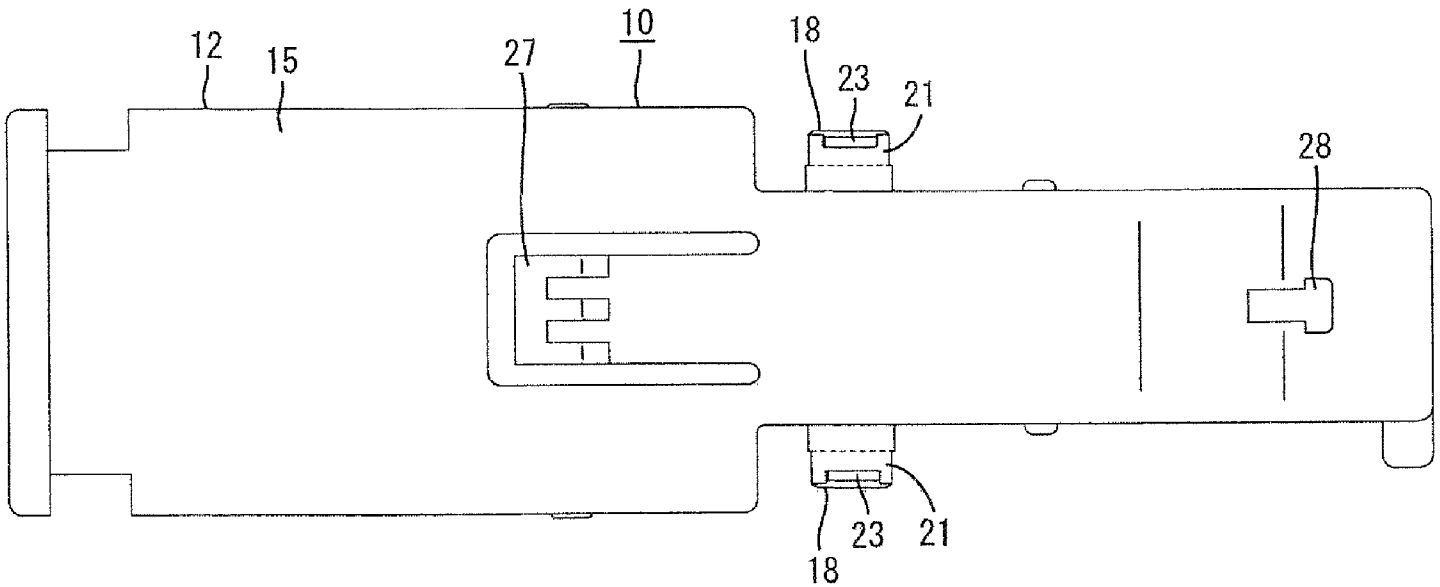
FIG. 10 is a rear view of the cover.
Figure 11:
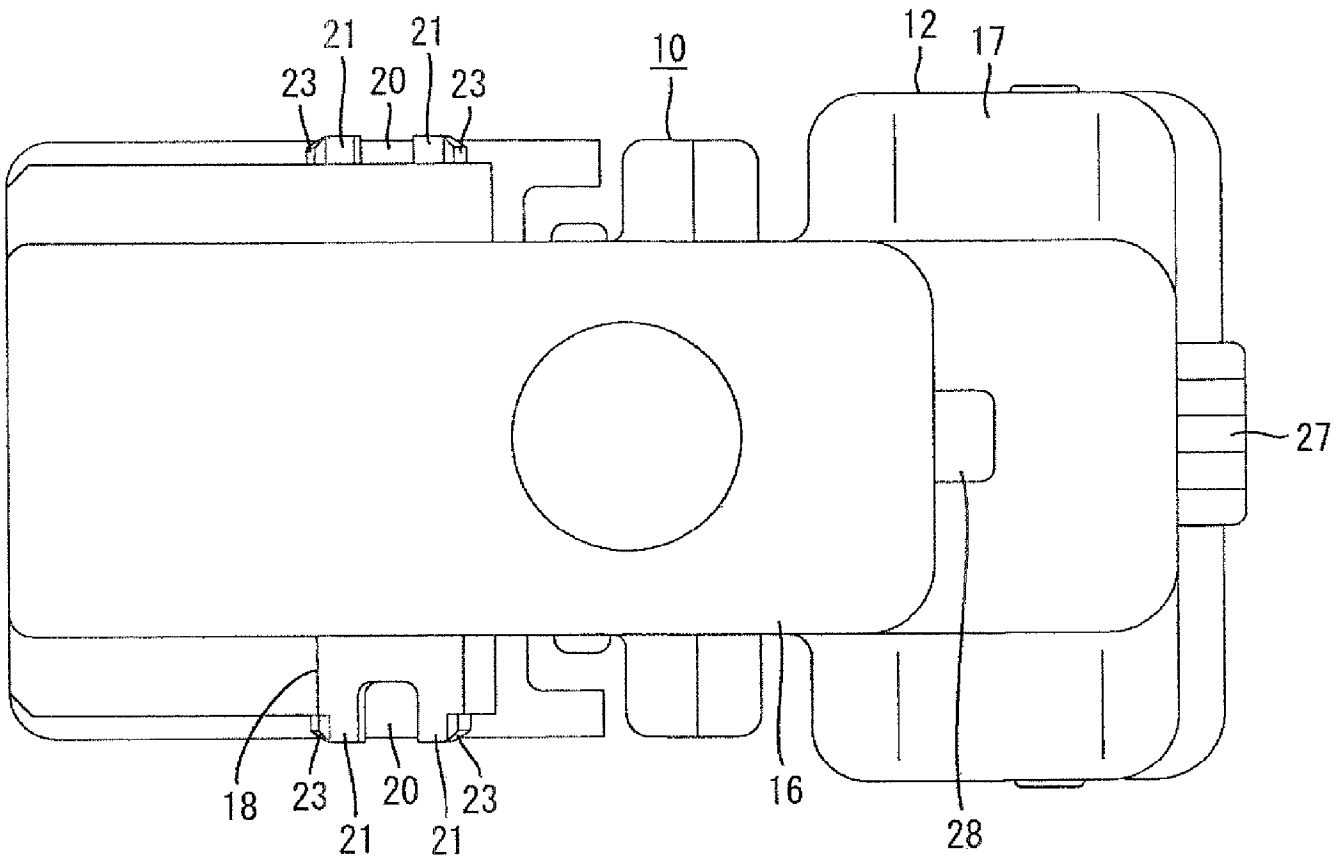
FIG. 11 is a plan view of the cover.

The cover 12 is cap-shaped and functions to pull out the wires drawn from the rear surface of the housing main body 11 in a specified direction. Specifically, as shown in FIGS. 9 to 11, the cover 12 has two side walls 14 facing in a width direction, a rear wall 15 connecting the rear ends of the opposite side walls 14 and an upper wall 16 connecting the upper ends of the opposite side walls 14. The cover 12 also has an open front for mounting on the housing main body 11 and an open bottom for drawing out the wires.

Bulges 17 bulge out in the width direction at rear lower parts of the opposite side walls 14. Two supporting shafts 18 project in vertically intermediate parts of the outer surfaces of the opposite side walls 14 for rotatably supporting the lever 60.

A recess 20 is formed in a central part of the projecting end of each supporting shaft 18, and two retaining pieces 21 stand at substantially opposite sides of the recess 20. The recess 20 is formed by boring the supporting shaft 18 from the projecting end to an intermediate position at approximately half the projecting height and has a substantially round shape centered on a center of rotation of the lever 60 when viewed from a projecting end.

Escaping grooves 22 are formed at the opposite radial outer ends of the recess 20 between the retaining pieces 21 to separate the retaining pieces 21 and to communicate with the recess 20. Each retaining piece 21 has an arcuate shape substantially along the circle of the recess 20 when viewed from the projecting end and is resiliently deformable towards the recess 20. A leading-end flange 23 projects radially at the outer peripheral edge of the leading end of the retaining piece 21. The leading-end flanges 23 are arranged on intermediate parts of the outer peripheral edge of the retaining pieces 21 and extend in substantially opposite directions. Slanted surfaces 29 are defined on the outer surfaces of the leading-end flanges 23 and are sloped down towards the radial outer sides (see FIG. 4). The supporting shaft 18 is laterally symmetrical with an axial center thereof on each of the side walls 14.

The rear wall 15 is comprised of a first straight portion 24 extending substantially straight up or out from the bottom end. A curved slope 25 slopes up from the upper end of the first straight portion 24 and a second straight portion 26 extends substantially straight up and out from the upper end of the slope 25 to the upper wall 16. The first straight portion 24 and the slope 25 are connected via a curved section and the slope 25 and the second straight portion 26 are connected via a curved section. A lever full lock 27 is formed in the rear surface of the first straight portion 24 by cutting, and a lever partial lock 28 projects from the rear surface of the connecting section between the slope 25 and the second straight portion 26. The inner surface of the rear wall 15 defines a wire guiding surface for bending and guiding the wires in the specified direction.

Figure 12:
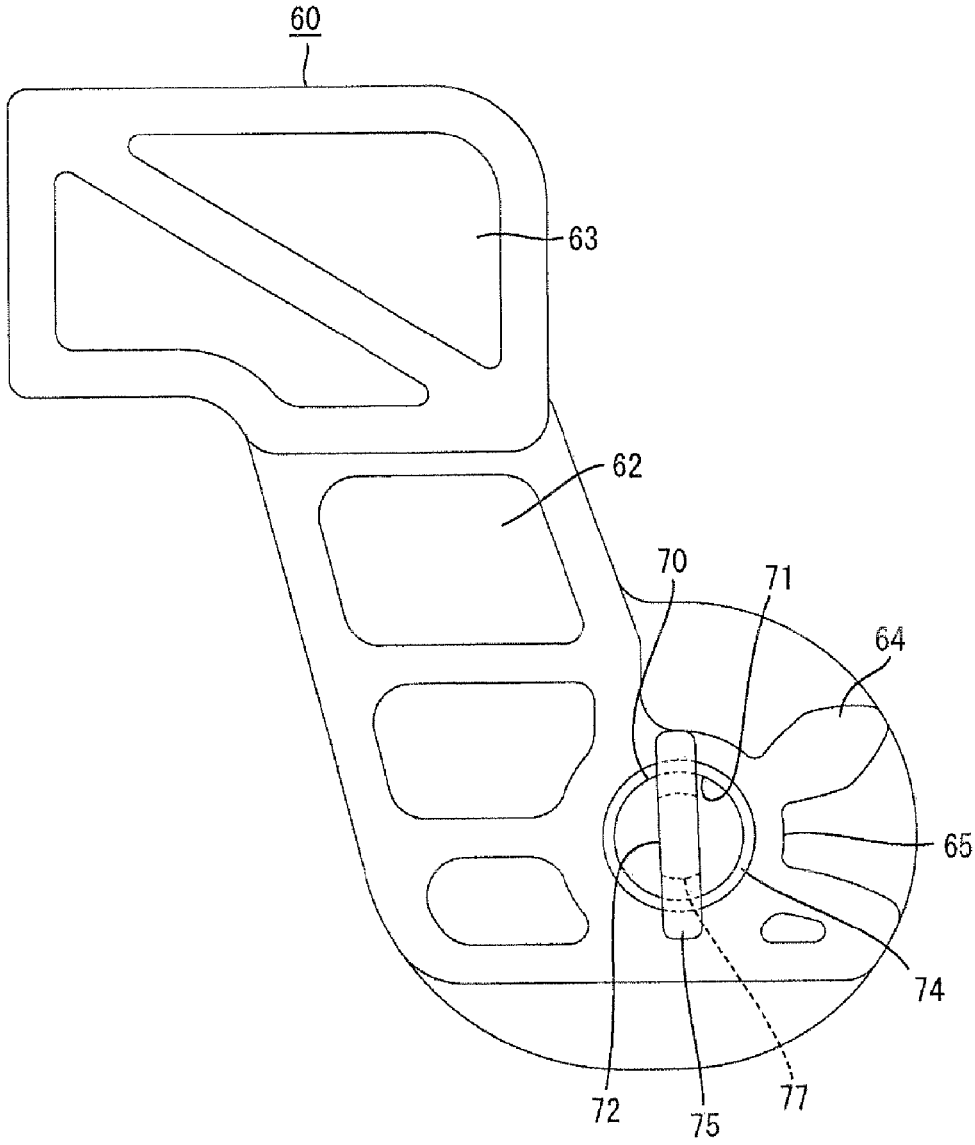
FIG. 12 is a side view of the lever.
Figure 13:
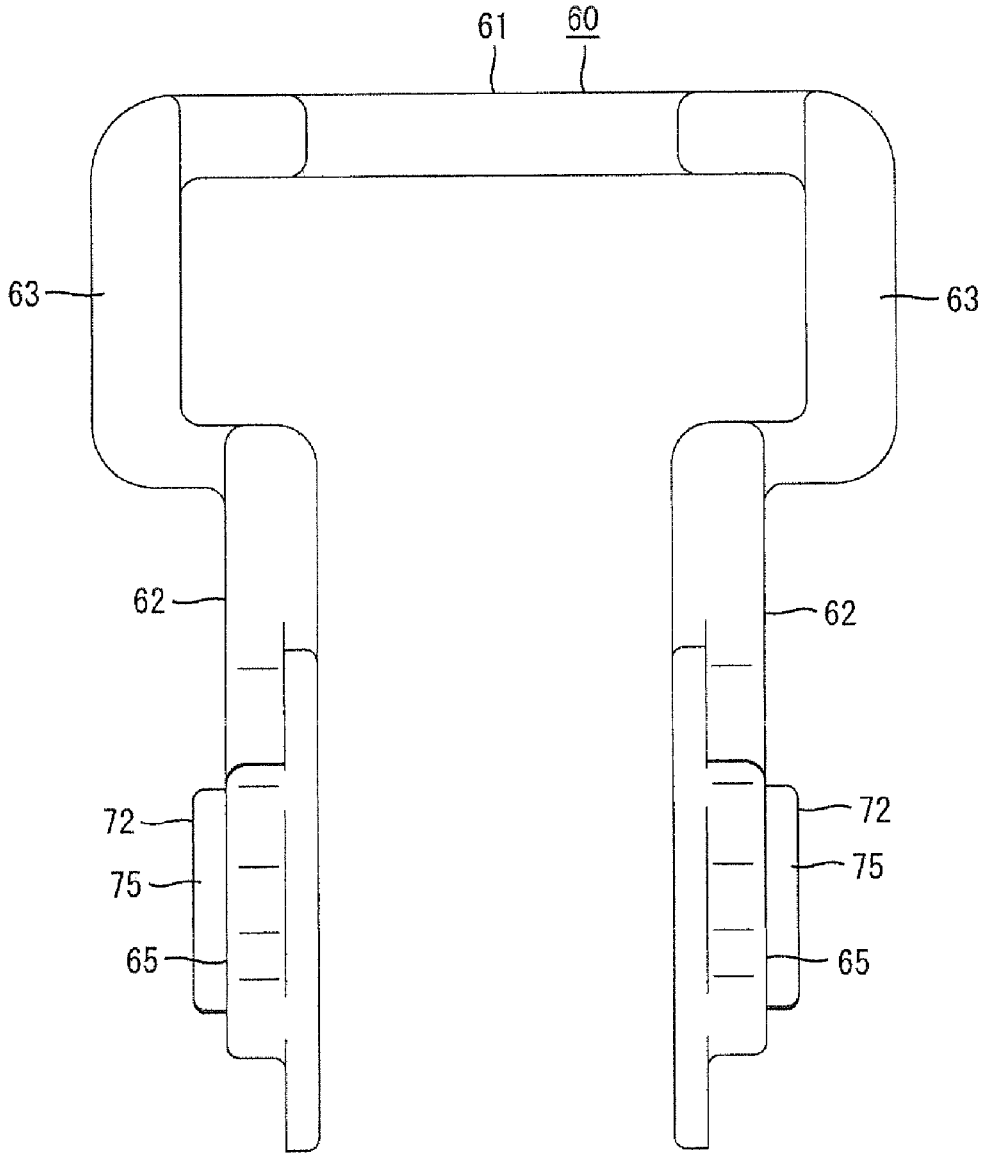
FIG. 13 is a front view of the lever.

The lever 60 is made e.g. of synthetic resin and includes an operable portion 61. Two parallel arms 62 project from the opposite ends of the operable portion 61 to define a gate-shape or U-shape, as shown in FIGS. 12 and 13. It should be understood that the lever 60 may be substantially plate-like and may have an operable portion at one of its ends. The operable portion 61 has an interlocking portion (not shown) engageable with the lever partial lock 28 and the lever full lock 27 of the housing 10. An extension 63 is at a position of each arm 62 near the operable portion 61 and projects like a crank substantially in the width direction toward the operable portion 61. The extension 63 is engageable with the corresponding bulge 17 of the cover 12. An end of each arm 62 distant from the operable portion 61 has a substantially arcuate peripheral edge, and a gear-like pinion 65 having at least one pinion tooth 64 is provided on the outer surface thereof. The mating connector includes linear racks (not shown) having rack teeth. The pinion teeth 64 and the rack teeth engage with each other to advance the connecting operation of the connectors when the lever 60 is rotated about the supporting shafts 18. Alternatively or additionally, the force-multiplying action may be performed by a pinion extending along a groove and translates a movement of the lever into a translating connecting movement of the connector with the mating connector.

The bearing 70 for receiving the supporting shaft 18 is formed in the end portion of each arm 62. The bearing 70 is comprised of a shaft hole 71 that penetrates the arm 62 in a thickness direction and a restriction 72 connected unitarily with the outer surface of the arm 62 to bridge an opening of the shaft hole 71 in a radial direction. A large-diameter portion 73 is formed with a step 74 in the opening of the shaft hole 71 (see FIG. 4), and the leading-end flanges 23 of the retaining pieces 21 face the step 74 of the large-diameter portion 73 to engage the step 74 resiliently.

The restriction 72 is bar-shaped and has a beam-like bridge 75 one step higher than the outer surface of the arm 62 and extending substantially in the radial direction of the recess 20. The restriction 72 also has a projection 77 that projects from the inner surface of a longitudinal central part of the bridge 75 (see FIG. 5). The radial length of the projection 77 is substantially equal to the diameter of the recess 20. At the assembled position AP shown in FIGS. 3 and 4, the bridge 75 crosses the escaping grooves 22 and the opening of the recess 20 in the radial direction, and the projection 77 is accommodated in the recess 20 from the projecting end of the supporting shaft 18 and arranged between the retaining pieces 21 while being spaced apart from the retaining pieces 21 by a distance substantially equal to a maximum resilient deformation amount of the retaining pieces 21 (resilient deformation amount of the retaining pieces 21 immediately before the leading-end flanges 23 are released from a state facing the opening edge of the bearings 70). The restrictions 72 are located in deformation permitting areas with respect to the supporting shafts 18 in this state and resilient deformations of the retaining pieces 21 towards the recesses 20 are permitted. On the other hand, the bridges 75 are arranged to face and slide in contact with the projecting ends of the retaining pieces 21 and the projections 77 are arranged closely in a tense manner to slide in contact with the inner circumferential surfaces of the retaining pieces 21 when the lever 60 is rotated from the assembled position AP to the standby position and from the standby position to the proper connection position PCP. The supporting shafts 18 in this state are in deformation preventing areas with respect to the restrictions 72 where the resilient deformations of the retaining pieces 21 towards the recesses 20 are prevented.

Figure 3:
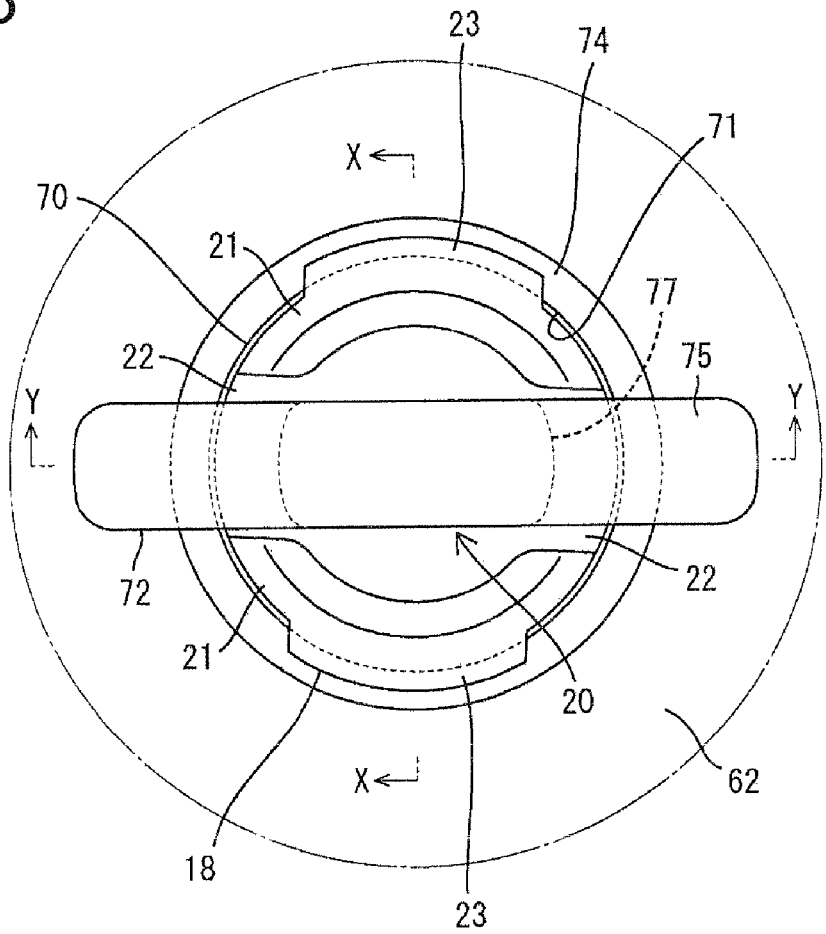
FIG. 3 is an enlarged side view of a bearing and a supporting shaft in which a restricting portion is located in a deformation permitting area.
Figure 4:
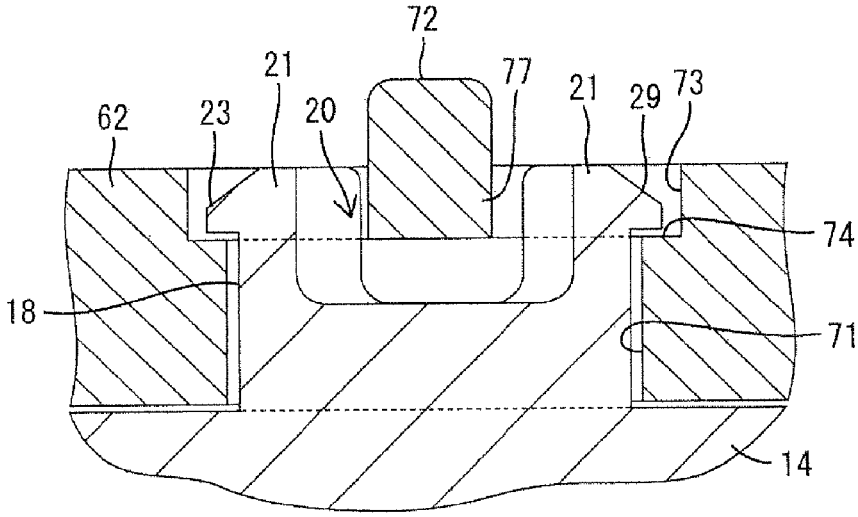
FIG. 4 is a section along X-X of FIG. 3.
Figure 5:
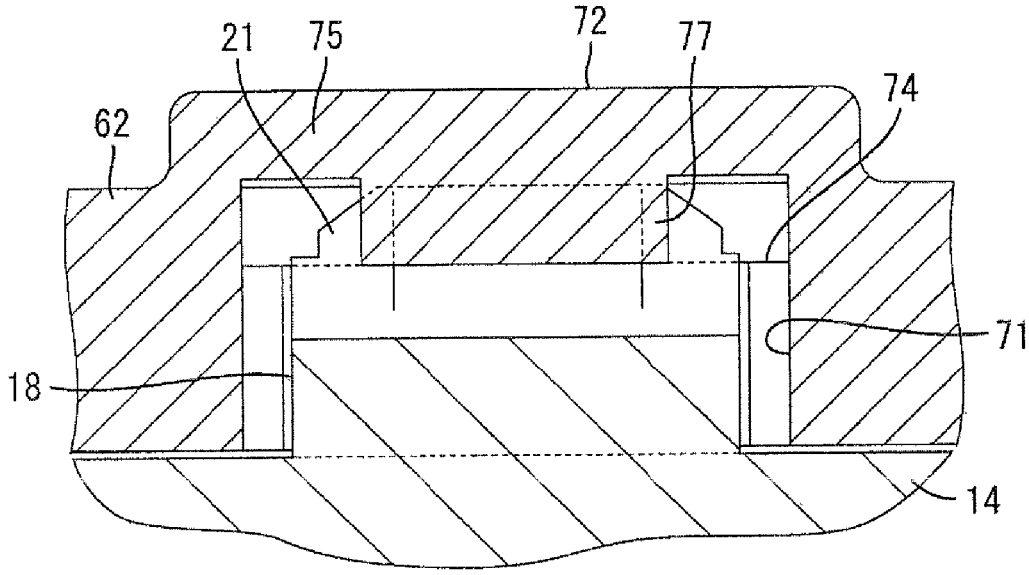
FIG. 5 is a section along Y-Y of FIG. 3.
Figure 8A:
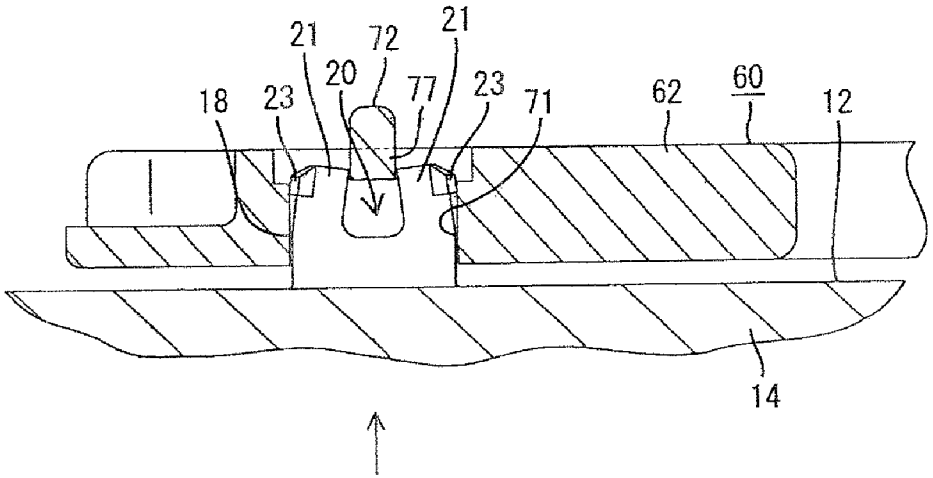
FIG. 8(A) is an enlarged longitudinal section showing an intermediate state of insertion of the supporting shaft into the bearing and FIG. 8(B) is an enlarged longitudinal section showing a state where the supporting shaft is properly inserted in the bearing.
Figure 8B:
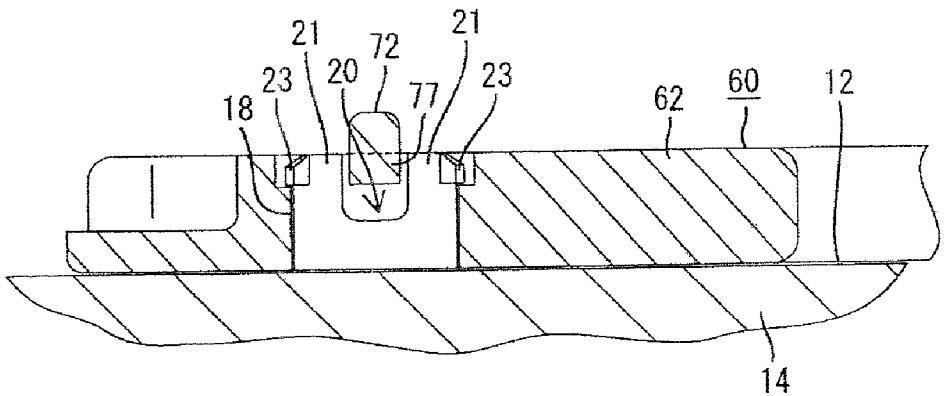

The connector is assembled by inserting the supporting shafts 18 into the bearings 70 of the cover 12 from inner sides to assemble the lever 60 with the housing 10. The interlocking portion then is engaged with the lever partial lock 28, as shown in FIG. 1, to hold the lever 60 at the assembled position AP. The restrictions 72 are located in the deformation permitting areas during the assembling process of the lever 60, as shown in FIG. 8(A). Thus, the projecting ends of the leading-end flanges 23 are held in sliding contact with the inner circumferential surfaces of the shaft holes 71 and the retaining pieces 21 are deformed resiliently towards the recesses 20. As a result, the supporting shafts 18 can be inserted into the shaft holes 71. Further, the leading ends of the resiliently deformed retaining pieces 21 contact the projections 77 of the restrictions 72 to prevent excessive deformations of the retaining pieces 21. The retaining pieces 21 resiliently restore when the lever 60 reaches the assembled position AP and the leading-end flanges 23 face the steps 74 of the large-diameter portions 73 in the shaft holes 71 and engage resiliently with the steps 74, as shown in FIGS. 3 and 8(B). As a result, the lever 60 is held on the supporting shafts 18 so as not to come off.

The operable portion 61 then is gripped and an operation force is given to the lever 60 in a counterclockwise direction. Thus, the lever partial lock 28 and the interlocking portion disengage, and the lever 60 is rotated about the supporting shafts 18 to reach the standby position. At the standby position, the operable portion 61 is distanced back from the cover 12, and the pinions 65 are arranged to receive the rack teeth of the racks. The restrictions 72 also are rotated about the center of rotation as the lever 60 is rotated and move to the deformation preventing areas. Thus, the projections 77 enter deformation spaces for the retaining pieces 21 and the retaining pieces 21 are arranged to interfere with the projections 77 and are held upright. Subsequently, the housing 10 is fit lightly into the mating connector and the lever 60 is rotated to the proper connection position PCP with the racks and the pinions 65 engaged.

In the process of rotating the lever 60 from the standby position to the proper connection position PCP, the leading-end flanges 23 of the retaining pieces 21 face and slide on the steps 74 of the large-diameter portions 73. Thus, the lever 60 cannot detach from the housing 10. At this time, connection resistance is produced between the mating connector and the housing 10 and a force acts on the lever 60 in a direction to widen the spacing between the arms 62. However, the projections 77 interfere with the retaining pieces 21 in resilient deforming directions of the retaining pieces 21 to prevent the resilient deformations of the retaining pieces 21. Therefore the leading-end flanges 23 and the steps 74 of the large-diameter portions 73 are kept reliably in their facing state and the deformations of the arms 62 in directions to widen the spacing therebetween are hindered.

Figure 2:
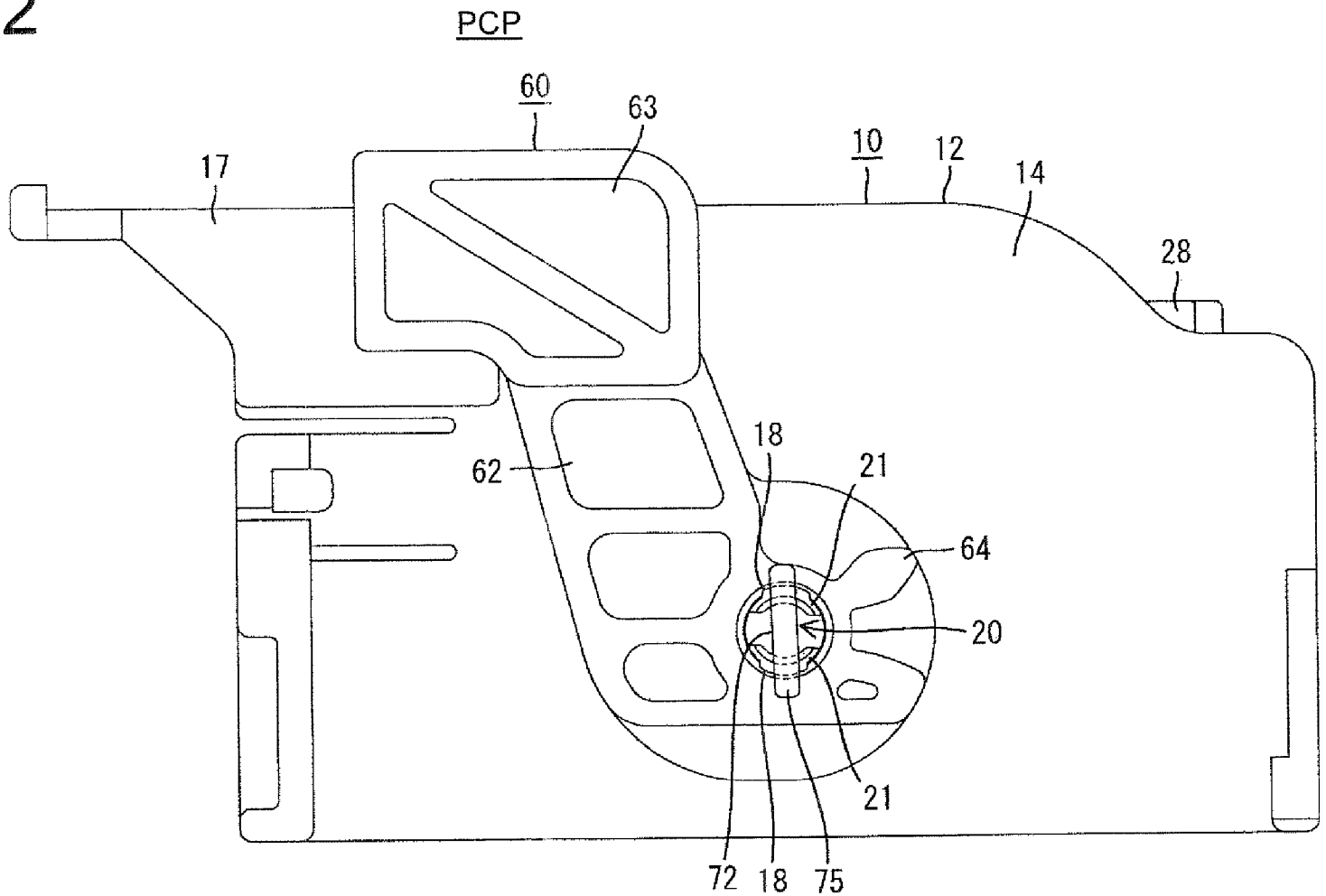
FIG. 2 is a side view of the connector with the lever left at a proper connection position.
Figure 6:
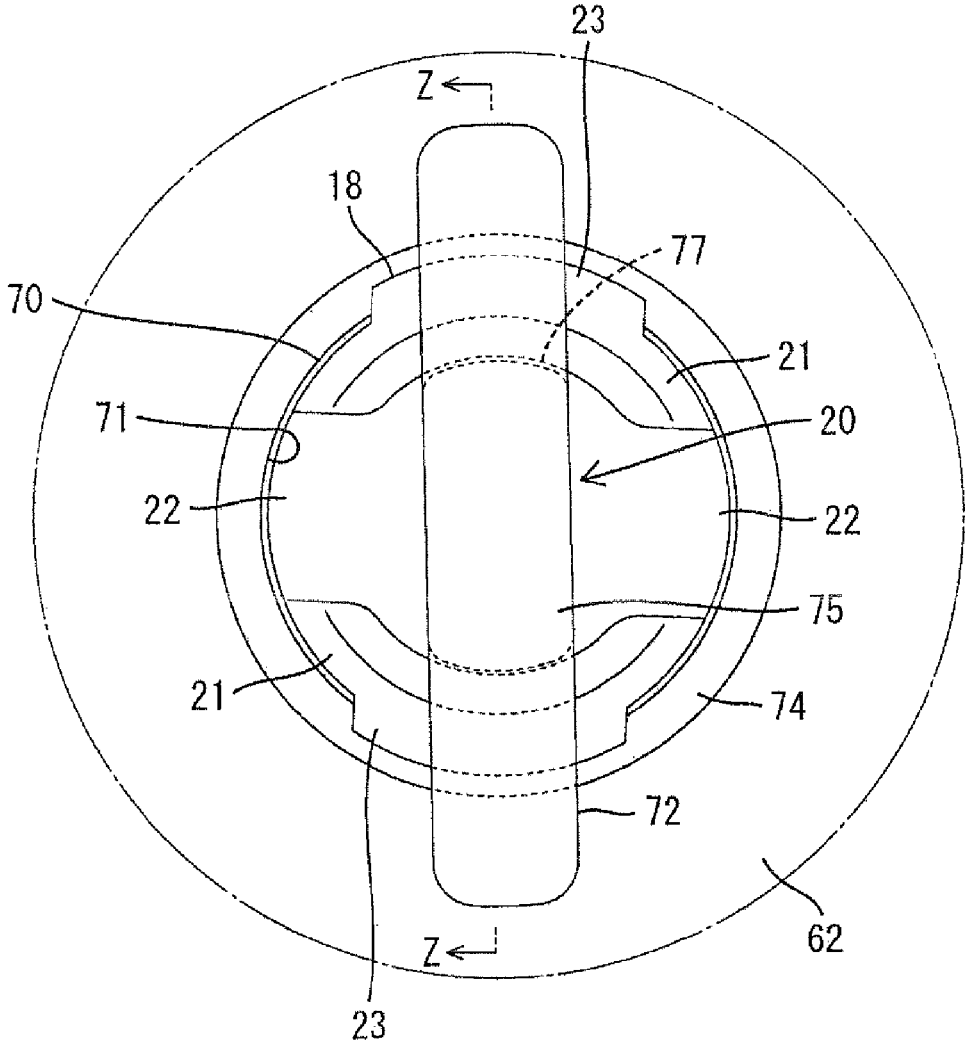
FIG. 6 is an enlarged side view of the bearing and the supporting shaft in which the restricting portion is located in a deformation preventing area.
Figure 7:
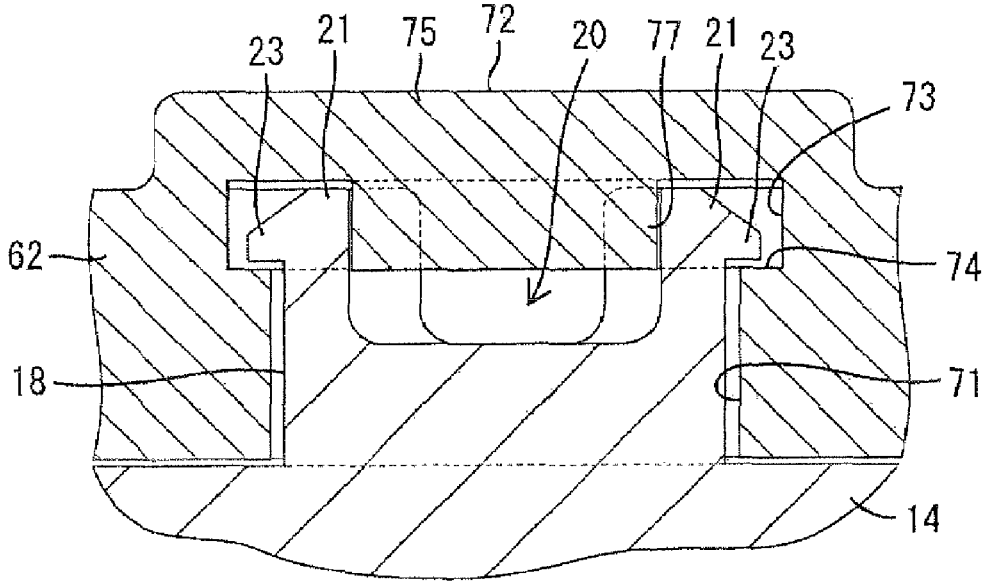
FIG. 7 is a section along Z-Z of FIG. 6.

The terminal fittings accommodated in the connectors are connected electrically to proper depths when the lever 60 reaches the proper connection position PCP. The engagement action of the lever full lock 27 and the interlocking portion, as shown in FIG. 2, holds the lever 60 at the proper connection position PCP so as not to rotate. In this case, the restrictions 72 are located constantly in the deformation preventing areas except when the lever 60 is at the assembled position AP. Thus, the resilient deformations of the retaining pieces 21 also are prevented at this proper connection position PCP, as shown in FIGS. 6 and 7. The lever 60 is rotated by about 90° from the assembled position AP to the proper connection position PCP and the restrictions 72 similarly are rotated by about 90°.

As described above, the restrictions 72 are located in the deformation permitting areas when the lever 60 is at the assembled position AP. Thus, the resilient deformations of the retaining pieces 21 towards the recesses 20 are permitted to ensure a smooth assembling operation of the lever 60. On the other hand, the restrictions 72 are in the deformation preventing areas when the lever 60 is rotated to prevent resilient deformations of the retaining pieces 21 towards the recesses 20 and the detachment of the lever 60 from the housing 10 is hindered reliably.

The assembled position AP is not located between the standby position and the proper connection position PCP. Thus, there is no likelihood of permitting the resilient deformations of the retaining pieces 21 even momentarily by passing the assembled position AP during the rotation of the lever 60. Therefore connection stability is good.

The invention is not limited to the above described and illustrated embodiment. For example, the following embodiments are also embraced by the technical scope of the present invention.

The supporting shafts may be provided on the lever and the bearings may be provided in the housing (cover).

The lever may be a cam lever including cam grooves and adapted to bring the housing to the proper connection position by a cam action between the cam grooves and cam followers provided on the mating connector as the lever is rotated. Alternatively, the lever may be a fulcrum lever for catching the mating connector and pulling it toward the housing as being rotated.

The cover may be omitted and the lever may be shaft-supported on the housing main body.

The assembled position and the standby position may be the same position.

Two or more pairs of retaining pieces may be provided around each recessed space.

As long as the leading-end flanges of the retaining pieces and the opening edges of the bearings are kept in their facing state, small clearances may be defined between the restrictions and the retaining pieces in the deformation preventing areas to permit slight resilient deformations of the retaining pieces.

The lever as the preferred movable member may be displaced along a path different from a rotational or pivotal path such as a substantially linear path (like a slider), substantially along a bent path or the like.

What is claimed is:

1. A connector, comprising:

a housing connectable with a mating connector, and a lever supported on the housing and having a force multiplying mechanism for connecting the housing and the mating connector by the displacement of the lever engaged with the mating connector, wherein:

one of the lever and the housing includes a supporting shaft and the other thereof includes a bearing, the supporting shaft includes a recess and retaining pieces adjacent to the recess, the retaining pieces being inserted into the bearing and having leading-end flanges resiliently engageable with an opening edge of the bearing, and the bearing includes at least one restriction at least partly insertable into the recess from a leading end side of the supporting shaft and being displaceable to a deformation permitting area where resilient deformations of the retaining pieces toward the recess are permitted when the lever is assembled and to a deformation preventing area where the resilient deformations of the retaining pieces towards the recess are prevented as the lever is operated.

2. The connector of claim 1, wherein the lever is displaceable to an assembled position corresponding to the deformation permitting area, a standby position where the engagement with the mating connector can be started and a proper connection position where the housing is properly connected.

3. The connector of claim 2, wherein the assembled position is not located between the standby position and the proper connection position corresponding to the deformation preventing area.

4. The connector of claim 1, wherein the restriction has a bar shape extending along a radial direction of the recess and is arranged in a tense state between two retaining pieces facing each other with the recess therebetween in the resilient deformation area.

5. The connector of claim 1, wherein the restriction is in the deformation permitting area when the lever is at the assembled position, whereby the resilient deformations of the retaining pieces towards the recesses are permitted to ensure a smooth assembling of the lever.

6. The connector of claim 1, wherein the lever is held at the assembled position so as not to move by the engagement action of a lever partial locking portion and an interlocking portion.

7. The connector of claim 1, wherein in the assembling process of the lever, the projecting ends of leading-end flanges of the retaining piece are held in sliding contact with inner circumferential surfaces of the bearing and the retaining pieces are resiliently deformed toward the recesses since at least one restriction unitarily connected with the lever are located in the deformation permitting areas with the result that the supporting shaft can be inserted into the bearing.

8. The connector of claim 1, wherein the resiliently deformed retaining pieces contact at least one projection of the restrictions to prevent excessive deformations of the retaining pieces.

9. A connector, comprising:

a housing, at least one supporting shaft projecting from the housing, the supporting shaft including a central recess and resiliently deflectable retaining pieces adjacent to and outwardly from the recess, the retaining pieces having leading-end flanges facing outwardly and away from the recess; and a lever having at least one bearing supported rotatably on the supporting shaft of the housing and having a force multiplying mechanism for connecting the housing and a mating connector by the displacement of the lever, the bearing having an opening edge for engaging the leading-end flanges of the supporting shaft, the bearing further including at least one restriction insertable into the recess and being displaceable to a deformation permitting area where resilient deformations of the retaining pieces towards the recess are permitted when the lever is assembled and to a deformation preventing area where the resilient deformations of the retaining pieces towards the recess are prevented as the lever is operated.

10. The connector of claim 9, wherein the restriction has a projection between the retaining pieces to limit deformations of the retaining pieces.

11. The connector of claim 9, wherein the restriction has a bar shape extending along a radial direction of the recess and is arranged in a tense state between two retaining pieces facing each other with the recess therebetween in the resilient deformation area.

* * * * *